US009584923B2

(12) United States Patent
Cho et al.

(10) Patent No.: US 9,584,923 B2
(45) Date of Patent: Feb. 28, 2017

(54) THREE-COIL TYPE ROUND WINDOW DRIVING VIBRATOR HAVING EXCELLENT DRIVING FORCE

(75) Inventors: Jin-Ho Cho, Daegu (KR); Hyung-Gyu Lim, Daegu (KR); Ki-Woong Seong, Daegu (KR); Jyung-Hyun Lee, Gyeongsan-si (KR)

(73) Assignee: KYUNGPOOK NATIONAL UNIVERSITY INDUSTRY-ACADEMIC COOPERATION FOUNDATION, Buk-gu, Daegu (KR)

( * ) Notice: Subject to any disclaimer, the term of this patent is extended or adjusted under 35 U.S.C. 154(b) by 158 days.

(21) Appl. No.: 13/524,150

(22) Filed: Jun. 15, 2012

(65) Prior Publication Data

US 2012/0323066 A1 Dec. 20, 2012

(30) Foreign Application Priority Data

Jun. 16, 2011 (KR) ..... 10-2011-0058541

(51) Int. Cl.
*H04R 9/06* (2006.01)
*H04R 25/00* (2006.01)

(52) U.S. Cl.
CPC ..... *H04R 9/066* (2013.01); *H04R 25/606* (2013.01)

(58) Field of Classification Search
CPC .... H04R 9/066; H04R 25/606; H04R 25/604; H04R 2225/67; H04R 2460/13; H04R 17/00; H04R 15/00; A61N 1/36032
USPC ..... 600/25
See application file for complete search history.

(56) References Cited

U.S. PATENT DOCUMENTS

| | | | | |
|---|---|---|---|---|
| 6,398,717 | B1 * | 6/2002 | Leysieffer et al. | 600/25 |
| 6,735,318 | B2 * | 5/2004 | Cho | 381/326 |
| 2004/0097785 | A1 * | 5/2004 | Schmid et al. | 600/25 |
| 2006/0087203 | A1 * | 4/2006 | Cho | 310/353 |
| 2009/0023976 | A1 | 1/2009 | Cho et al. | |
| 2009/0092271 | A1 | 4/2009 | Fay et al. | |

FOREIGN PATENT DOCUMENTS

| | | | |
|---|---|---|---|
| KR | 100859979 | B1 | 9/2008 |
| WO | 95/01710 | A1 | 1/1995 |

* cited by examiner

*Primary Examiner* — Christine H Matthews
*Assistant Examiner* — Kaylee Wilson
(74) *Attorney, Agent, or Firm* — Nath, Goldberg & Meyer; Jerald L. Meyer; Christopher Thomas

(57) ABSTRACT

The present disclosure provides a three-coil type round window driving vibrator, which includes a permanent magnet having the same magnetic poles adjoining each other and is designed to allow electric current flowing through coils to run in opposite directions in order to increase driving force without being affected by an external magnetic field. The round window driving vibrator includes a permanent magnet having three poles of SNS or NSN, a coil member wound around an outer periphery of the permanent magnet, and a vibration member connected to one end of the permanent magnet. Here, the coil member includes a first coil wound around a middle section of the permanent magnet and second and third coils wound around upper and lower sections of the permanent magnet, respectively.

8 Claims, 7 Drawing Sheets

THREE-COIL TYPE ROUND WINDOW DRIVING VIBRATOR HAVING EXCELLENT DRIVING FORCE

CROSS-REFERENCE TO RELATED APPLICATION

This application claims the benefit under 35 U.S.C. §119 of Korean Patent Application No. 10-2011-0058541, filed on Jun. 16, 2011 in the Korean Intellectual Property Office, the entirety of which disclosure is incorporated herein by reference.

BACKGROUND

1. Technical Field

The present invention relates to a round window driving vibrator, and more particularly to a two-magnet three-coil type round window driving vibrator, which is provided to an inlet of a round window in a cochlea to allow a person suffering from hearing loss to hear, and includes two permanent magnets arranged to have the same magnetic poles adjoining each other and three coils disposed around the permanent magnets such that a direction of electric current flowing through one of the coils is opposite to the direction of the electric current flowing through another coil adjacent thereto, in order to increase driving force without being affected by an external magnetic field.

2. Description of the Related Art

In many countries, as a low birth rate and increasing longevity lead to an expanding elderly population and the number of persons suffering from hearing loss increases due to frequent exposure to noise in daily life, demand for medical devices and otologic surgery for hearing aid tend to increase.

Hearing aids serve to amplify and modulate sound for a person suffering from hearing loss and can be classified based on the degree of difficulty in hearing and the placement position into an external type and an internal type. External type hearing aids can be conveniently mounted on the external ear, but has a disadvantage in that it cannot satisfy the needs for persons suffering from severe hearing loss.

Thus, internal type hearing aids are suited to persons suffering from severe hearing loss and can be classified into an implantable artificial middle ear for replacing the middle ear and an implantable artificial inner ear for replacing the inner ear.

The implantable artificial middle ear hearing aid generally includes a microphone and a vibrator, and has been mainly studied in that this type of hearing aid can achieve effective transfer of sound signals to persons suffering from severe hearing loss through a simple structure thereof. The human ear is composed of an external ear, a middle ear and an inner ear, and external sound signals are sequentially transferred therethrough. Most implantable artificial middle ear hearing aids are designed to apply vibration to the oval window of the cochlea through these paths of the ear. Recently, however, it has been spotlighted to develop implantable artificial middle ear hearing aids which apply vibration from the round window of the cochlea through a reverse path.

In the implantable artificial middle ear hearing aid, the vibrator may be classified into an electromagnetic vibrator including a permanent magnet and a coil, and a piezoelectric vibrator including a piezoelectric device and electrodes. In designing the vibrator of the implantable artificial middle ear hearing aid, various factors such as biostability, biocompatibility, a smaller volume for easier implantation, and low power consumption are taken into consideration. To this end, there is a need for high performance vibrators. Particularly, despite low design costs, the piezoelectric vibrator has difficulty in realizing a high voltage output unit for operation of the vibrator while minimizing power consumption under spatial restriction.

Although the electromagnetic vibrator is broadly used for compensating for hearing of a person suffering from sensorineural hearing loss, a round window driving vibration transducer employing the electromagnetic method provides low driving force, making it difficult to achieve improved efficiency, particularly, in a high frequency band.

BRIEF SUMMARY

Therefore, the present invention is aimed at providing a three-coil type round window driving vibrator, which enhances high frequency characteristics so as to help a person suffering from sensorineural hearing loss and is designed to allow electric current flowing through coils to run in opposite directions in order to increase driving force.

In accordance with one aspect of the present invention, a round window driving vibrator, which includes a permanent magnet having three poles of SNS or NSN; a coil member wound around an outer periphery of the permanent magnet; and a vibration member connected to one end of the permanent magnet. Here, the coil member includes a first coil wound around a middle section of the permanent magnet and second and third coils wound around upper and lower sections of the permanent magnet, respectively. The first, second and third coils are arranged such that a direction of electric current flowing through the second coil is the same as that of the electric current flowing through the third coils and a direction of the electric current flowing through the first coil is opposite the direction of the electric current flowing through the second and third coils.

In accordance with another aspect of the present invention, a round window driving vibrator, which includes a permanent magnet formed to have three poles of SNS or NSN; a case open at an upper side thereof to receive the permanent magnet; a coil member wound around an outer periphery of the permanent magnet; a vibration plate connected to one end of the permanent magnet and protruding from the case; and a support plate disposed on a bottom surface of the case and connected to the other end of the permanent magnet. Here, the coil member includes a first coil wound around a middle section of the permanent magnet and second and third coils wound around upper and lower sections of the permanent magnet, respectively. The first, second and third coils are arranged such that a direction of electric current flowing through the second coil is the same as that of the electric current flowing through the third coils and a direction of the electric current flowing through the first coil is opposite the direction of the electric current flowing through the second and third coils.

BRIEF DESCRIPTION OF THE DRAWINGS

The above and other aspects, features, and advantages of the invention will become apparent from the detailed description of the following embodiments in conjunction with the accompanying drawings, in which.

DETAILED DESCRIPTION

Figure 1:
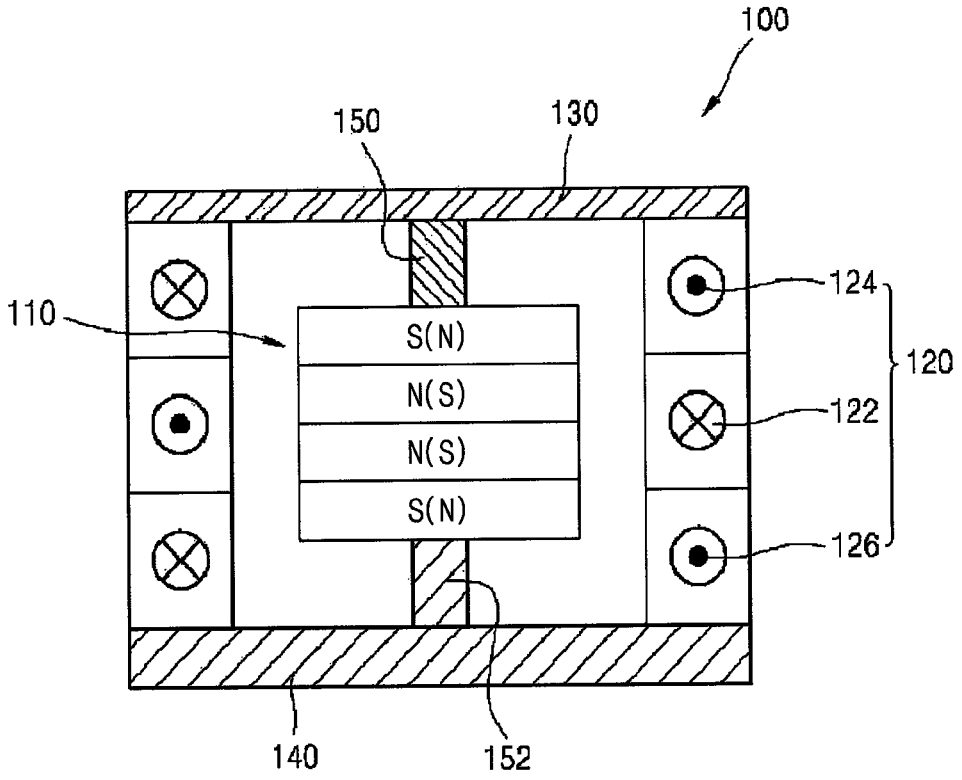
FIG. 1 is a side sectional view of a three-coil type round window driving vibrator in accordance with one embodiment of the present invention.

Exemplary embodiments of the invention will now be described in detail with reference to the accompanying drawings. It should be understood that the present invention is not limited to the following embodiments and may be embodied in different ways, and that the embodiments are given to provide complete disclosure of the invention and to provide thorough understanding of the invention to those skilled in the art. The scope of the invention is limited only by the accompanying claims and equivalents thereof. Like components will be denoted by like reference numerals throughout the specification.

Figure 2:
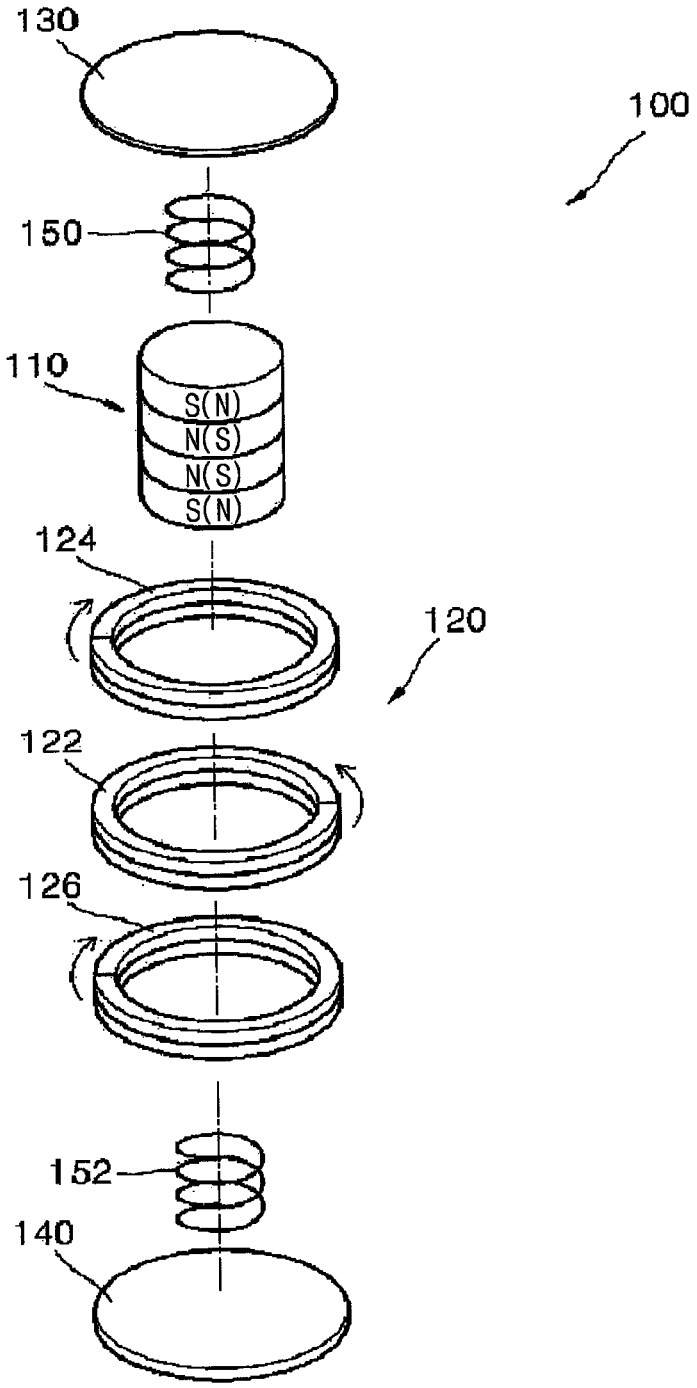
FIG. 2 is an exploded perspective view of the three-coil type round window driving vibrator in accordance with the embodiment of the present invention.

FIG. 1 is a side sectional view of a three-coil type round window driving vibrator in accordance with one embodiment of the present invention and FIG. 2 is an exploded perspective view of the three-coil type round window driving vibrator in accordance with the embodiment of the present invention.

Referring to FIGS. 1 and 2, the round window driving vibrator 100 according to one embodiment includes a permanent magnet 110, a coil member 120, a vibration member 130, and a support plate 140. The round window driving vibrator 100 may further include a vibration transfer member 150 and a vibration control member 152.

The permanent magnet 110 may be composed of a pair of magnets attached to each other such that the same poles adjoin each other. In one embodiment, the permanent magnet 110 may have three poles of SNS, in which a middle section of the permanent magnet 110 has a positive polarity (+), and upper and lower sections thereof have a negative polarity (−). In another embodiment, the permanent magnet 110 may have three poles of NSN, in which the middle section has a negative polarity (−), and the upper and lower sections have a positive polarity (+). The permanent magnet 110 may have various shapes including a cylindrical shape, a rectangular parallelepiped shape, a hexagonal pillar shape, and the like, without being limited thereto. In this embodiment, the permanent magnet 110 has a cylindrical shape.

The coil member 120 is wound around an outer periphery of the permanent magnet 110. The coil member 120 and the permanent magnet 110 are separated from each other to maintain a suitable distance therebetween.

The coil member 120 may be composed of a first coil 122 wound around the middle section of the permanent magnet 110, and second and third coils 124, 126 wound around the upper and lower sections of the permanent magnet 110, respectively. The coil member may be disposed such that the direction of electric current flowing through the second coil 124 is the same as the direction of the electric current flowing through the third coil 126 and the direction of the electric current flowing through the first coil 122 is opposite to the direction of the electric current flowing through the second and third coils 124, 126.

As the direction of the electric current flowing through the first coil 122 is opposite to that of the electric current flowing through the second and third coils 124, 126, the respective coils 122, 124, 126 are subjected to force generated by the permanent magnet 110 in the same direction, and suitable arrangement of the permanent magnet 110 and the first, second, and third coils 122, 124, 126 will allow the round window driving vibrator 100 to generate maximum driving force.

The vibration member 130 is connected to one end of the permanent magnet 110. The vibration member 130 may be referred to a vibration diaphragm. The vibration member 130 receives vibration transferred from the permanent magnet 110 and the coil member 120.

The support plate 140 is connected to the other end of the permanent magnet 110. The support plate 140 has a plate shape for sealing the vibrator 100 and may be made of a rigid material.

The vibration transfer member 150 is disposed between the vibration member 130 and the permanent magnet 110, and the vibration control member 152 is disposed between the support plate 140 and the permanent magnet 110. The vibration transfer member 150 may be made of a rigid material or an elastic material. The vibration transfer member 150 may have various shapes, for example, a coil spring shape. More advantageously, the vibration transfer member 150 is made of a rigid material rather than an elastic material in order to allow efficient transfer of vibration of the permanent magnet 110.

Further, the vibration control member 152 may be made of a rigid material or an elastic material and may have various shapes, for example, a coil spring shape.

In particular, the coil spring shape of the vibration transfer member 150 and the vibration control member 152 allows individuals suffering from hearing loss to hear by adjusting the frequency characteristics of the round window driving vibrator 100 according to individual hearing loss characteristics.

Although not specifically shown in the drawings, the round window driving vibrator 100 may further include a first current supply line (not shown) through which voltage of a first polarity is applied to the first coil 122 of the coil member 120, and a second current supply line (not shown) through which voltage of a second polarity opposite the first polarity is applied to the second and third coils 124, 126. In this case, alternating current may be applied to the first to third coils such that the direction of electric current flowing through the first coil 122 is opposite to the direction of the electric current flowing through the second and third coils 124, 126.

Figure 3:
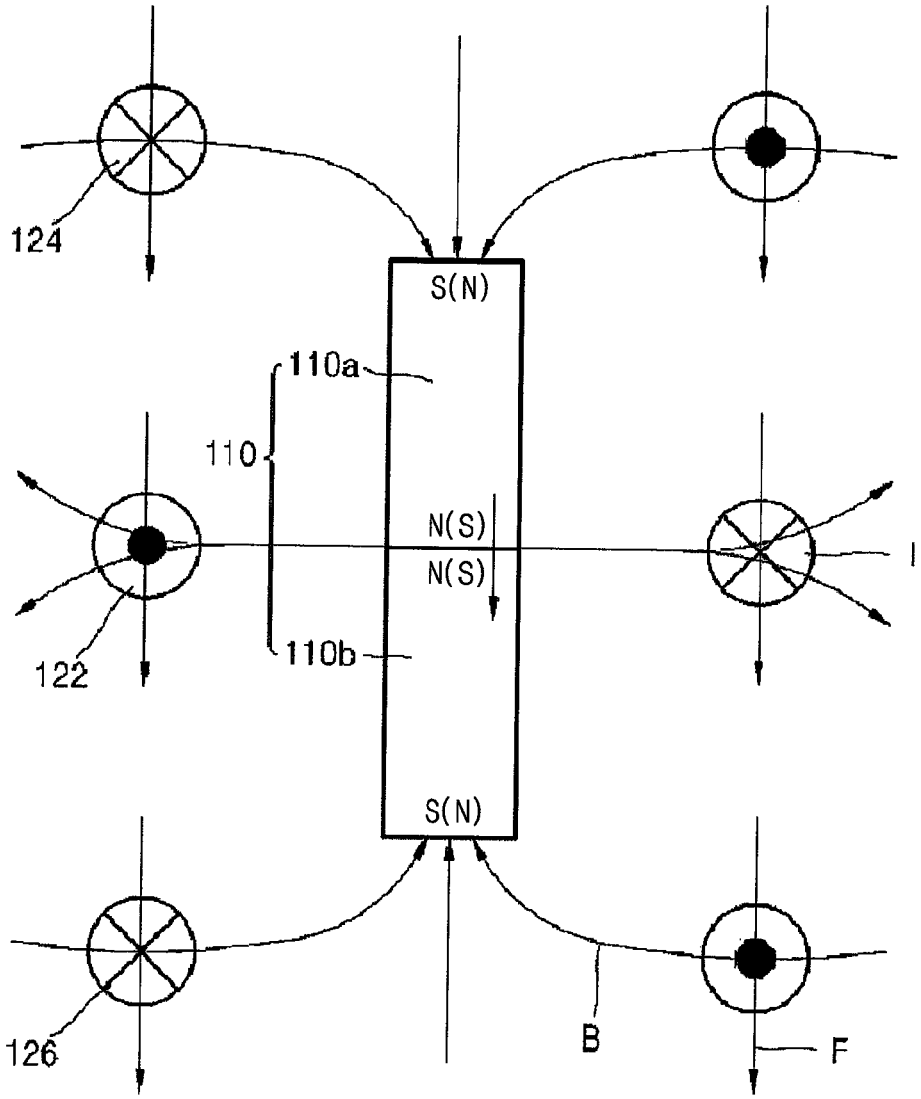
FIG. 3 is a diagram illustrating an operating principle of the three-coil type round window driving vibrator in accordance with the embodiment of the present invention.

FIG. 3 is a diagram illustrating an operating principle of the three-coil type round window driving vibrator in accordance with the embodiment of the present invention.

In FIG. 3, the permanent magnet 110 may be composed of a pair of magnets 110*a*, 110*b* to have three poles of SNS in which N-poles adjoin each other. Alternatively, the permanent magnet 110 may have three poles of NSN in which S-poles adjoin each other. In this case, in order to increase driving force, the coils are arranged such that the direction of electric current flowing through the first coil 122 is opposite the direction of the electric current flowing through the second and third coils 124, 126.

When electric current I is applied to the first, second and third coils 122, 124, 126 as shown in FIG. 3, the first coil 122 is subjected to force F by lines of magnetic flux B from the N-pole of the permanent magnet 110 and the electric current I flowing through the coils 122, 124, 126 in a direction shown in FIG. 3 according to Fleming's left hand rule. In addition, the second and third coils 124, 126 are subjected to force F by lines of magnetic flux B entering the S-pole of the permanent magnet 110 and the electric current I flowing through the coils 122, 124, 126 in a direction shown in FIG. 3.

Thus, when electric current is applied to the first to third coils 122, 124, 126 such that the direction of the electric current flowing through the first coil 122 is opposite to the direction of the electric current flowing through the second and third coils 124, 126 according to distribution of the lines of magnetic flux B from the permanent magnet 110, it is possible to apply force to the coils 122, 124, 126 in the same direction.

Here, since the coils 122, 124, 126 are secured to the round window driving vibrator 100 and the permanent magnet 110 is not physically restricted, the permanent magnet 110 is subjected to the force F in the opposite direction of the force F applied to the coils 122, 124, 126 by the law of action and reaction.

In this way, when alternating current is applied to the coils 122, 124, 126, the permanent magnet 110 generates vibration in a vertical direction, and the vibration is transferred to the vibration member 130 through the vibration transfer member 150.

As described above, in the three-coil type round window driving vibrator according to this embodiment, the coil member is disposed around the permanent magnet to allow electric current flowing through adjacent coils to run in opposite directions, thereby increasing driving force.

As such, the round window driving vibrator provides higher driving force than existing electromagnetic vibrators having the same size as that of the round window driving vibrator, thereby reducing the volume and power consumption of the vibrator. As a result, the round window driving vibrator according to the present invention may realize a low power-consumption implantable artificial middle ear having a very small size.

Figure 4:
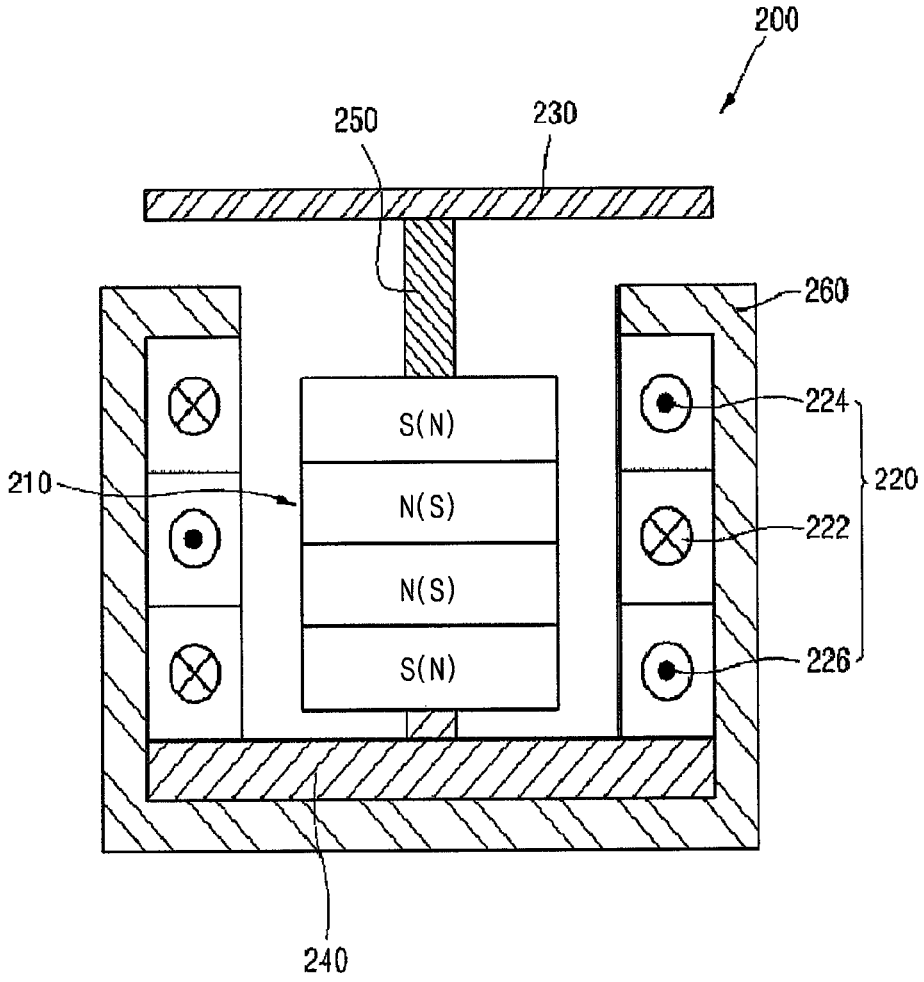
FIG. 4 is a side sectional view of a three-coil type round window driving vibrator in accordance with another embodiment of the present invention.

FIG. 4 is a side sectional view of a three-coil type round window driving vibrator in accordance with another embodiment of the present invention.

Referring to FIG. 4, the three-coil type round window driving vibrator 200 according to this embodiment includes a permanent magnet 210, a coil member 220, a vibration plate 230, and a support plate 240. The round window driving vibrator 200 may further include a vibration transfer member 250 and a case 260.

The permanent magnet 210 may have three poles of SNS and a cylindrical structure. Alternatively, the permanent magnet 210 may have three poles of NSN.

The coil member 220 may be composed of a first coil 222 wound around a middle section of the permanent magnet 210, and second and third coils 224, 226 wound around upper and lower sections of the permanent magnet 210, respectively. The coil member may be disposed such that the direction of electric current flowing through the second coil 224 is the same as the direction of the electric current flowing through the third coil 226 and a direction of the electric current flowing through the first coil 222 is opposite to the direction of the electric current flowing through the second and third coils 224, 226.

The vibration plate 230 is connected to one end of the permanent magnet 210 and protrudes from the case 260 described below.

The support plate 240 is connected to the other end of the permanent magnet 210. The support plate 240 is configured to be sealed by the case 260. The support plate 240 received inside the case 260 may be made of an elastic material to provide the function of the vibration control member shown in FIG. 1. Therefore, the vibrator of this embodiment may eliminate a separate design for the vibration control member shown in FIG. 1.

Figure 5:
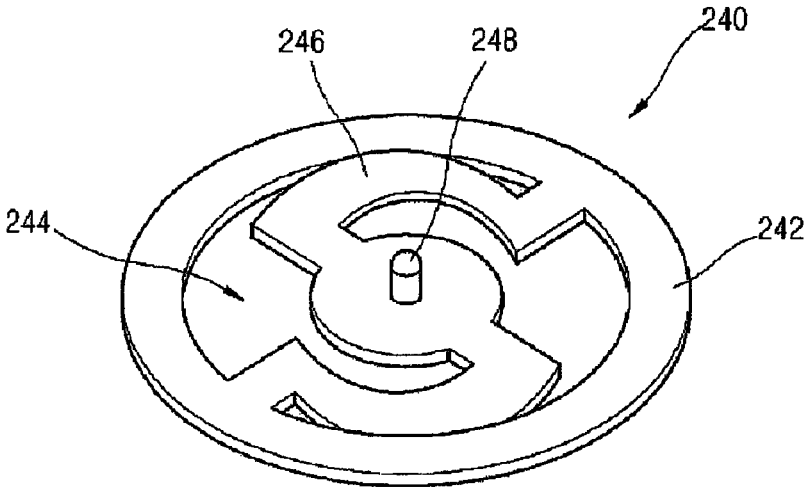
FIG. 5 is a perspective view of a support plate of FIG. 4.
Figure 6:
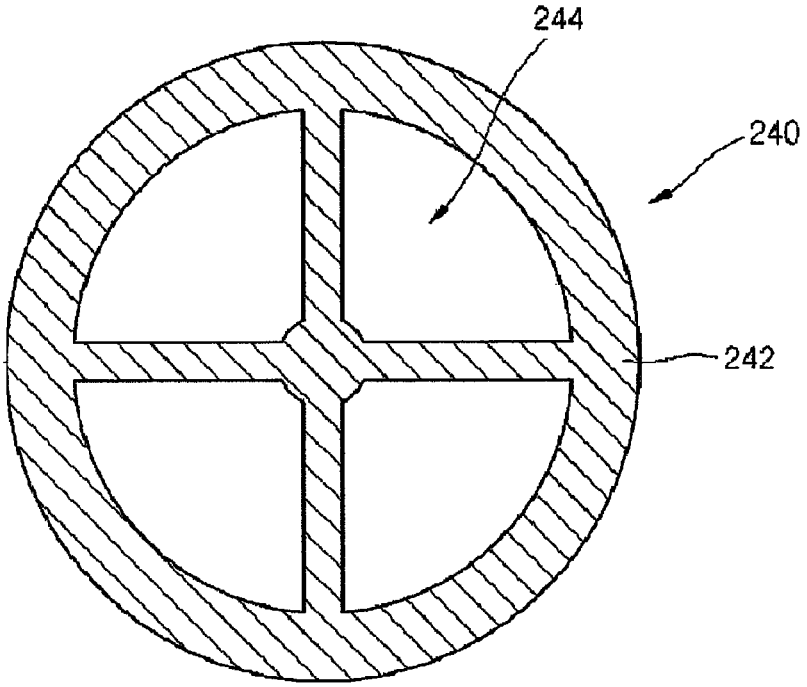
FIG. 6 and FIG. 7 are plan views of modifications of the support plate of FIG. 4.
Figure 7:
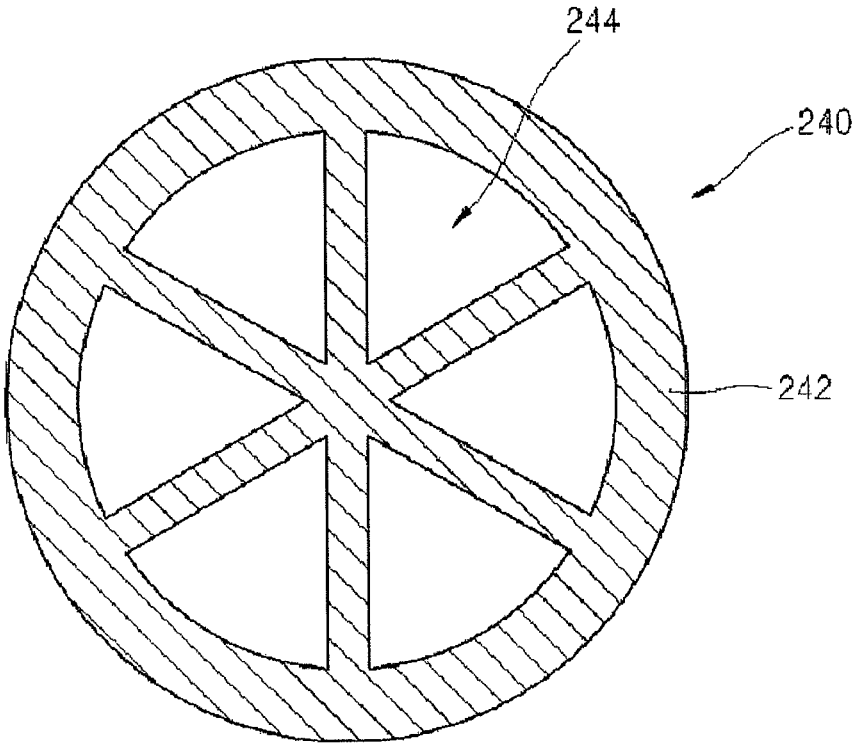

FIG. 5 is a perspective view of a support plate of FIG. 4, and FIG. 6 and FIG. 7 are plan views of modifications of the support plate of FIG. 4.

As shown in FIG. 5, the support plate 240 may have a plate-spring shape and include a body 242, cut-away sections 244 formed by cutting parts of the body 242, and a rounded section 246 extending from an edge of the body 242 to the center of the body 242.

The support plate 240 may further include a vibration control pin 248 placed at the center of the body 242 to control vibration caused by driving of the permanent magnet 210.

Here, the body 242 may have various shapes including a circular shape, oval shape, rectangular shape, and pentagonal shape, without being limited thereto. FIG. 5 shows one example of the body 242 having a circular shape, in which the body 242 may have four circular rims defined by the cut-away sections 244. In some embodiments, two cut-away sections 244 may be symmetrically placed, with the vibration control pin 248 disposed therebetween. In this embodiment, the rounded section extends from an edge of the body through a center of the body to another edge of the body. The rounded section is a unitary structure comprising at least two arcs on opposite sides of the body.

In the modifications shown in FIG. 6 and FIG. 7, the support plate 240 may have a plate-spring shape and include a body 242, four or six cut-away sections 244 penetrating a central region of the body 242, and a rounded section 246 extending from an edge of the body 242 to the center of the body 242 so as to. Although not shown in the drawings, the support plate 240 according to the modification may further include a vibration control pin (not shown) placed at the center of the body 242 to control vibration caused by driving of the permanent magnet 210.

Referring again to FIG. 4, the vibration transfer member 250 is placed between the vibration plate 230 and the permanent magnet 210. The vibration transfer member 250 may be made of a rigid material or an elastic material. The vibration transfer member 250 may have various shapes, for example, a coil spring shape. More advantageously, the vibration transfer member 250 is made of a rigid material rather than an elastic material in order to allow efficient transfer of vibration of the permanent magnet 210.

The coil spring shape of the vibration transfer member 250 allows individuals suffering from hearing loss to hear by adjusting the frequency characteristics of the round window driving vibrator 200 according to individual hearing loss characteristics When the vibration transfer member 250 permits effective transfer of vibration from the permanent magnet 210 and the coil member 220 to the round window, the vibrator may eliminate the vibration plate 230.

The case 260 has a container shape open at an upper side thereof and receives the permanent magnet 210 therein. The case 260 may be made of a biocompatible material such as titanium Ti. The coil member 220 is placed inside the case 260 and surrounds the outer periphery of the permanent magnet 210.

Here, although the permanent magnet 210 is illustrated as being received inside the case 260 and the vibration plate 230 is illustrated as protruding from the case 260 in FIG. 4, this configuration is provided by way of illustration and these components may be mounted to the case in various ways. For example, although not shown in the drawings, the vibration plate 230 may be coupled to an upper side of the case 260 to seal the upper side of the case 260 or may be inserted into the case 260 in order to prevent the permanent magnet 210 from being exposed to an external environment.

In terms of vibration transfer efficiency, the structure wherein the vibration plate 230 is disposed to protrude from the case 260 is advantageous, and in terms of reliability, the structure wherein the vibration plate 230 is coupled to the case 260 to seal the permanent magnet 210 is advantageous.

In the round window driving vibrator according to this embodiment, since the vibration plate protrudes from the case while being separated from the case, the vibration plate may more effectively receive vibration from the permanent magnet and the coil member.

Figure 8:
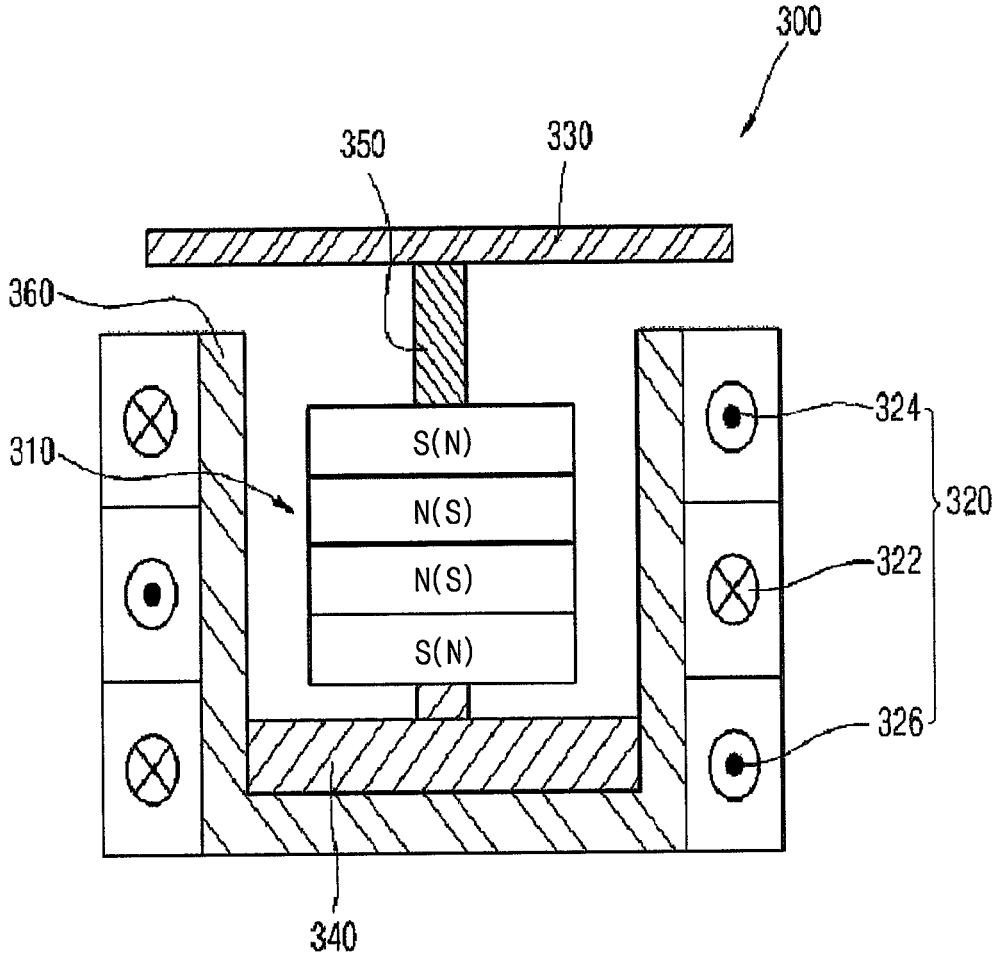
FIG. 8 is a side sectional view of a three-coil type round window driving vibrator in accordance with a further embodiment of the present invention.

FIG. 8 is a side sectional view of a three-coil type round window driving vibrator in accordance with a further embodiment of the present invention. The round window driving vibrator according to this embodiment has a similar configuration to that of the round window driving vibrator according to the above embodiment, and a repeated description of the components will be omitted herein.

Referring to FIG. 8, the round window driving vibrator 300 according to this embodiment includes a case 360 placed between a permanent magnet 310 and a coil member 320.

With the structure wherein the case 360 is placed between the permanent magnet 310 and the coil member 320, it is easy to design the coil member 320 such that first, second and third coils 322, 324, 326 are wound around the outer periphery of the case 360. In this embodiment, since the case 360 is placed between the permanent magnet 310 and the coil member 320, the case 360 may be made of a non-magnetic material so as not to obstruct lines of magnetic flux B applied to the coil member 320.

As described above, in the three-coil type round window driving vibrator according to the present invention, the coil member is disposed around the permanent magnet to allow electric current flowing through adjacent coils to run in opposite directions in order to increase driving force.

Accordingly, the round window driving vibrator according to the invention provides higher driving force than existing electromagnetic vibrators having the same size as that of the round window driving vibrator, thereby reducing the volume and power consumption of the vibrator. As a result, the round window driving vibrator according to the present invention may realize a low power-consumption implantable artificial middle ear having a very small size.

Although some exemplary embodiments have been described herein, it should be understood by those skilled in the art that these embodiments are given by way of illustration only, and that various modifications, variations and alterations can be made without departing from the spirit and scope of the invention. Therefore, the scope of the invention should be limited only by the accompanying claims and equivalents thereof.

What is claimed is:

1. A round window driving vibrator comprising:

a permanent magnet having three poles of SNS or NSN;

a case opened at an upper side thereof to receive the permanent magnet;

a coil member wound around an outer periphery of the permanent magnet, the coil member comprising a first coil wound around a middle section of the permanent magnet and second and third coils wound around upper and lower sections of the permanent magnet, respectively, the first, second and third coils being arranged such that a direction of electric current flowing through the second coil is the same as that of the electric current flowing through the third coils and a direction of the electric current flowing through the first coil is opposite the direction of the electric current flowing through the second and third coils;

a vibration plate connected to one end of the permanent magnet; and a support plate disposed on a bottom surface of the case and connected to the other end of the permanent magnet, wherein the vibration plate is disposed to protrude from the case, and the vibration plate is spaced apart from the case, the round window driving vibrator further comprises a vibration transfer member disposed between the vibration plate and the permanent magnet, the vibration transfer member is connected at one end to the vibration plate and is connected at the other end to the permanent magnet such that the one end connected to the vibration plate protrudes out of the case, the support plate comprises a unitary body formed by cutting away sections of the body, wherein the body includes a circular rim, a circular central hub, and two rounded spokes located on opposing sides of the central hub, the rounded spokes each including a linear section and an arcuate section, wherein a first end of the linear section of each spoke is connected to opposing sides of the central hub and the arcuate section extends from a second end of the linear section to an edge of the circular rim, the support plate further comprises a vibration control pin disposed at a center of the central hub to control vibration caused by driving of the permanent magnet, and the round window driving vibrator is adapted to be provided at an inlet of a round window in a cochlea.

2. The round window driving vibrator according to claim 1, wherein the case is disposed outside the coil member.

3. The round window driving vibrator according to claim 1, wherein the case is disposed between the coil member and the permanent magnet, and the coil member is attached to an outer surface of the case to surround the outer periphery of the permanent magnet.

4. The round window driving vibrator according to claim 1, wherein the case is made of a non-magnetic material.

5. A vibrator comprising:

a magnet having a first pole, a second pole and a third pole, the first pole being opposite to the second and third poles and disposed therebetween;

a coil member comprising a first coil, a second coil and a third coil wound around an outer periphery of the first pole, the second pole and the third pole of the magnet, respectively;

a vibration plate connected to one end of the magnet;

a case opened at one side thereof to receive the magnet inside thereof through the opened side;

a support plate disposed on a bottom surface of the case and connected to the other end of the magnet; and a vibration transfer member disposed between the vibration plate and the magnet, wherein the support plate comprises a unitary body formed by cutting away sections of the body, wherein the body includes a circular rim, a circular central hub, and two rounded spokes located on opposing sides of the central hub, the rounded spokes each including a linear section and an arcuate section, wherein a first end of the linear section of each spoke is connected to opposing sides of the central hub and the arcuate section extends from a second end of the linear section to an edge of the circular rim, the support plate further comprises a vibration control pin disposed at a center of the central hub to control vibration caused by driving of the magnet, the vibrator is adapted to be provided at an inlet of a round window in a cochlea, and the vibration transfer member is connected at one end to the vibration plate and is connected at the other end to the magnet such that the one end connected to the vibration plate protrudes out of the case.

6. The vibrator according to claim 5, wherein the first coil, the second coil and the third coil are configured such that a direction of the electric current flowing through the first coil is opposite to a direction of the electric current flowing through the second and third coils.

7. The vibrator according to claim 5, wherein the first coil, the second coil and the third coil are configured such that the first coil, the second coil and the third coil are subjected to a force in the same direction.

8. The vibrator according to claim 5, wherein the magnet comprises a pair of magnets with S or N poles being attached to each other.

* * * * *